US011981407B2

(12) United States Patent
Gai et al.

(10) Patent No.: US 11,981,407 B2
(45) Date of Patent: May 14, 2024

(54) HYDRAULIC STEERING DEVICE FOR A BOAT, A VESSEL, OR THE LIKE

(71) Applicant: Ultraflex S.p.A., Genoa (IT)

(72) Inventors: Marcella Gai, Genoa (IT); Enrico Pagani, Genoa (IT)

( * ) Notice: Subject to any disclaimer, the term of this patent is extended or adjusted under 35 U.S.C. 154(b) by 947 days.

(21) Appl. No.: 16/947,415

(22) Filed: Jul. 31, 2020

(65) Prior Publication Data

US 2021/0061426 A1 Mar. 4, 2021

(30) Foreign Application Priority Data

Aug. 26, 2019 (IT) ..... 102019000015042

(51) Int. Cl.

| | |
|---|---|
| ***B63H 20/12*** | (2006.01) |
| ***B63B 79/40*** | (2020.01) |
| ***B63H 25/02*** | (2006.01) |

(52) U.S. Cl.

CPC ..... *B63B 79/40* (2020.01); *B63H 25/02* (2013.01); *B63H 2025/022* (2013.01)

(58) Field of Classification Search

CPC ..... B63H 20/08; B63H 20/12; B63H 20/14; B63H 2025/022; F02B 61/045; F02B 61/04; F16D 31/02; B62D 5/065; B62D 5/062; B62D 5/064; B63B 79/40

See application file for complete search history.

(56) References Cited

U.S. PATENT DOCUMENTS

| | | | | |
|---|---|---|---|---|
| 5,074,193 | A | 12/1991 | Hundertmark | |
| 5,746,055 | A * | 5/1998 | Nakamura | F02B 61/045 91/169 |
| 5,928,041 | A * | 7/1999 | Anderson | B63H 20/12 440/61 C |
| 6,273,771 | B1 * | 8/2001 | Buckley | B63H 21/213 114/144 RE |

(Continued)

FOREIGN PATENT DOCUMENTS

| | | | | |
|---|---|---|---|---|
| CN | 109131547 | A * | 1/2019 | B62D 5/06 |
| DE | 10037829 | A1 * | 2/2002 | B62D 5/003 |

(Continued)

*Primary Examiner* — George C Jin
*Assistant Examiner* — Teuta B Holbrook
(74) *Attorney, Agent, or Firm* — Themis Law

(57) ABSTRACT

A hydraulic steering device for boats, vessels or the like, includes a hydraulic pump coupled to a drive motor to feed a drive fluid alternately according to two flow directions; a hydraulic actuating cylinder connected to the delivery and return of the pump; and a fluid flow distributor switching the connection of the delivery and suction of the pump alternatively to one of two inlets/outlets of the cylinder communicating with one of two chambers of the cylinder. The actuating cylinder is mechanically articulated to a steering member, which determines direction change by modifying its orientation relative to an axis of the boat, the vessels or the like, preferably to a longitudinal axis, the modification of steering member orientation being implemented by the actuating cylinder according to the supply of the drive fluid to the cylinder caused by operation of the pump. The motor (Continued)

has inputs for a power supply signal to drive the pump to supply fluid flow according to one of the two predetermined directions of flow.

11 Claims, 10 Drawing Sheets

(56) References Cited

U.S. PATENT DOCUMENTS

| | | | | |
|---|---|---|---|---|
| 6,298,941 | B1 * | 10/2001 | Spadafora | F15B 13/021 701/41 |
| 6,662,559 | B1 | 12/2003 | Cook | |
| 6,890,227 | B1 * | 5/2005 | Alby | B63H 20/106 440/61 R |
| 10,054,956 | B1 * | 8/2018 | Anschuetz | G05D 1/0875 |
| 2002/0042233 | A1 * | 4/2002 | Michel | B63H 21/21 440/38 |
| 2005/0282448 | A1 * | 12/2005 | Tawa | B63H 20/12 440/61 S |
| 2006/0252316 | A1 * | 11/2006 | Tawa | B63H 20/10 440/61 S |
| 2013/0049310 | A1 * | 2/2013 | Renninger | B60G 17/048 280/5.514 |
| 2017/0101166 | A1 * | 4/2017 | Gai | B63H 25/38 |
| 2019/0063472 | A1 * | 2/2019 | Blanding | F04B 1/2042 |

FOREIGN PATENT DOCUMENTS

| | | | | |
|---|---|---|---|---|
| EP | 0395420 | A2 * | 10/1990 | |
| JP | 2004196015 | A * | 7/2004 | B63H 20/12 |
| JP | 2006264522 | | 10/2006 | |
| JP | 2006264522 | A * | 10/2006 | |

* cited by examiner

H - H

HYDRAULIC STEERING DEVICE FOR A BOAT, A VESSEL, OR THE LIKE

BACKGROUND OF THE INVENTION

The invention relates to a hydraulic steering device for boats, small vessels or the like, comprising:

a hydraulic pump coupled to a drive motor for feeding a drive fluid alternately according to two directions of flow;

at least one hydraulic actuator cylinder which is connected to the delivery and return of said pump;

a fluid flow distributor that switches the connection of the delivery and intake of said pump alternatively to one of two cylinder inlets/outlets communicating with one of two chambers of said cylinder;

said actuator cylinder or the rod of the actuator cylinder being mechanically articulated to a direction variation element, which steering variation element determines the direction variation by modifying its orientation relative to an axis of said boat, vessel or the like, preferably to a longitudinal axis;

the modification of the orientation of said direction variation organ being implemented by said actuator cylinder as a function of the hydraulic fluid supply to said cylinder caused by the operation of the pump;

and wherein said motor has inputs for a power supply signal for driving said pump to supply the fluid flow according to one of the two provided directions of flow.

BACKGROUND OF THE INVENTION

Devices of this kind have been known for some time, as described for example in document EP1598267 of the same owner. This document describes a directional steering system of a boat that operates according to an electro-hydraulic architecture. One or more steering wheels or rudder wheels are each associated with an electro-mechanical transducer transforming the angular displacement of the steering wheel or rudder into a corresponding command signal. A power supply signal for the motor of a pump is generated by means of a control unit, which supplies a pressurized fluid, typically oil, to a steering cylinder, preferably a double-acting cylinder.

The generated command signal takes into account the speed of rotation of the steering wheel and the direction of rotation, so that the pump motor is rotationally driven with a direction of rotation and a speed of rotation such as to cause the actuator cylinder to slide and consequently the propulsion propeller orientation of an engine or of a rudder to change correspondingly to the movement performed by the steering wheel.

These types of systems have the drawback of being formed by separate construction parts, which are mounted distanced on the hull of the boat, so that both the hydraulic circuit and the electrical circuit require to lay fairly large lengths of cable or pipe. Such lengths of pipe or cable not only imply an increase in material and installation costs, but also constitute points of potential breakage and therefore of potential malfunction of the device.

Furthermore, the fact of being made up of separate parts distributed over a certain extent makes devices of this type unsuitable for use in small boats that use outboard motors. In small boats it is even more difficult and complex to position long sections of pipe and/or cable which therefore constitute a further aesthetic and comfort limitation of the boat.

SUMMARY OF THE INVENTION

The purpose of the invention is therefore to provide a hydraulic steering device for boats or small vessels or the like of the type described at the beginning, which device can overcome the drawbacks of known devices and can also constitute a valid alternative to control devices steering currently in use on small boats and using outboard motors.

The invention also aims to make installation easier and the line connecting the directional control organ, such as a steering wheel to the steering device, less invasive or cumbersome.

According to a first aspect, the present invention solves the problem posed via a hydraulic steering device for boats, small vessels or the like, comprising:

a hydraulic pump coupled to a drive motor for feeding a drive fluid alternatively according to two flow directions;

at least one hydraulic actuator cylinder which is connected to the delivery and return of said pump;

a fluid flow distributor that switches the connection of the delivery and intake of said pump alternatively to one of two cylinder inlets/outlets communicating with one of two chambers of said cylinder;

said actuator cylinder or rod of the actuator cylinder being mechanically articulated to a direction variation member, which steering variation member determines the direction variation by modifying its orientation relative to an axis of the said boat, said small vessel or similar, preferably to a longitudinal axis;

the modification of the orientation of the said direction variation organ being implemented by said actuator cylinder as a function of the hydraulic fluid supply to the said cylinder caused by the operation of the pump;

and wherein said motor has inputs for a power signal for the operation of said pump to supply the fluid flow according to one of the two directions of flow provided, said device being further characterized in that said cylinder, said pump, said distributor/manifold and said motor are attached together to form an operating unit integrated in a single body.

In a variant embodiment, the rod of the actuator cylinder is stationary, while the cylinder slides along it in the two directions according to the oil supply to one or the other cylinder chamber and the said pump, said distributor/manifold and said motor being translated together with said cylinder along its rod.

In a further executive variant, the cylinder is stationary, while the rod moves in two directions with respect to it, so that said pump, said distributor/manifold and said motor are also stationary.

Thanks to this device, all the elements comprised in a steering system are integrated into a single body that can be attached to the steering arm of the outboard motor and to the transom of the boat or to another useful part of the same. For obvious reasons, the steering wheel or one or more directional control members such as a joystick, a bar, or the like remain separate. However, in this case, the fact that the directional control member transmits the control signals in the form of electrical signals makes the connection of the directional member or of two or more directional members provided in combination much simpler and less cumbersome, electric cables being considerably simpler to lay than conduits for a fluid under pressure and generally also less bulky and more flexible.

A preferred embodiment provides that the ducts that connect the pump, or the distributor/manifold to the cylinder inlets/outlets, are made partially integrated in a support plate integral with the cylinder and said pump, said distributor/manifold and said motor are attached to the at least said cylinder.

A variant embodiment provides that said plate can be fastened or attached to the cylinder or that the plate and the cylinder are made in one piece in a single body.

The electrical signals can be generated for example by means of electromechanical transducers, i.e. transducers reading the movement of the directional member and generate corresponding signals.

Executive variants may have optical and/or magnetic means for generating the steering command signals, as described for example in document EP3392132 of the same owner or in document EP1889781 of the same owner.

Further variants may comprise variable rheostats equipped with rotating or linearly translatable cursors and which are operated via a mechanical transmission by the movement of the directional control member.

The information relating to one or more displacement parameters, such as the displacement stroke and/or the displacement speed and/or the acceleration of the directional member during displacement, can be encoded in the electrical signals.

An embodiment of the device according to the present invention provides that the hydraulic cylinder is of the double-acting type, in particular for hydraulic steering devices of outboard marine engines, which outboard engines comprise a terminal for attaching to the boat transom on which said engine is rotatably mounted around a substantially vertical steering axis, which cylinder is slidably mounted on at least one rod coaxial to said cylinder, which rod sealingly protrudes from at least one head of the actuator cylinder and carries a separator piston dividing the cylinder into two variable volume chambers, each of which two chambers has at least one inlet/outlet for the hydraulic control fluid which inlet/outlet outlet is connected to the delivery and intake of the pump, said rod being provided to be connected to a bracket for attaching said cylinder to said engine, in a non-sliding way and in such a way as to allow the relative rotation of said engine with respect to the transom and/or the longitudinal axis of the boat according to an axis parallel to the axis of the rod.

This embodiment provides the use in the device according to the present invention of actuating cylinders of the type currently in use such as those described for example in document WO2007/085515 or in document EP3372487 of the same owner. This makes it possible to maintain the traditional methods of dynamic coupling of the actuator cylinder to the engine making it easier to install the device since at least in part it is already known to the installers of the sector. In addition, the performance and reliability of traditional actuator cylinders are maintained, thus maintaining a constant level and perception of reliability among users.

According to yet another feature, in order to allow the pump delivery to be switched alternatively to one or the other of the two chambers of the double-acting actuator cylinder, the invention provides that the delivery and intake of the pump are connected to the actuator cylinder by means of a switching unit, which unit is provided connected to the delivery and intake of the pump and comprises switching valves for the connection of the delivery and intake of the pump to the outputs of said switching unit for the alternative connection of said delivery and said intake to the cylinder inlets/outlets.

This switching unit is also known as regards the operating principle and is provided for example in axial piston pumps used in hydraulic steering systems in which the pumps are operated manually directly by the rotation of the steering wheel or rudder, for example as described in document EP1382845 and EP2857680 of the same owner, being the skilled man able to extrapolate the functions of the distribution valve associated with this type of manual pumps.

A particular embodiment of the present invention provides a common support frame for the hydraulic cylinder, for the motor and for the hydraulic pump, the distribution valve and the hydraulic pipes connecting the pump to said distribution valve and to the hydraulic cylinder said common frame being interposed between said hydraulic cylinder and said motor, said pump and distributor/manifold.

According to an additional aspect of the present invention, the actuator according to one or more of the forms and executive variants described above is part of a steering system for boats, small vessels or the like, said device being provided in combination with:

at least one steering control member (1), such as a steering wheel, a tiller or a rudder wheel;

which steering control member controls a generator of a steering control signal comprising a transducer of the displacement of said control member in a corresponding electrical signal;

a control unit transforming said electrical steering command signal into a corresponding power supply signal for said engine;

a source of electrical power for said motor power signal.

In one embodiment also the control unit and/or the source of electrical energy are provided integrated in the structure of said device or are also supported by the actuator cylinder such as for example by the plate integral with it and to which the motor, the pump with the changeover group and the distributor/manifold are attached.

An additional embodiment provides that the device is attached to an intermediate frame for attaching the engine to the boat, which frame has a terminal for attaching to said boat and an end for attaching to said engine.

According to a further feature, said intermediate frame is made in the manner of a cradle or case for housing at least part of the units building said device selected from one or more of the following parts:

the electric motor;

the fluid supply pump and/or the switching unit and/or optionally a pressure fluid reservoir;

the distributor/manifold;

the electronic control unit;

the power source of electricity for powering the said control unit and said motor;

at least part of the hydraulic pipes;

at least part of the electrical connection cables.

In the present description and in the claims, the term electronic control unit defines both the electronic units necessary for controlling the pump drive motor, and electronic units which, in addition to those for controlling the pump drive motor, may include one or more of the following control units:

logic unit for controlling the propulsion and/or maneuvering engine(s) of the boat;

a control logic of a further control member such as for example a joystick or the like, a control unit of an inertial platform associated with the actuator cylinder or with a part of the steering system.

In the present introduction to the detailed description, in the following detailed description of the execution example and in the claims the term "hydraulic" means systems that operate with any working fluid, such as oil or other fluids suitable for providing viscosity performance, and compression behavior useful for the execution of the expected functions.

Additional improvements and executive variations of the present invention are the subject of the dependent claims.

BRIEF DESCRIPTION OF THE DRAWINGS

The features described above and further features and the relative advantages of the present invention will become clearer from the following description of some embodiments illustrated in the attached drawings wherein.

DETAILED DESCRIPTION OF EMBODIMENTS OF THE INVENTION

Figure 1:
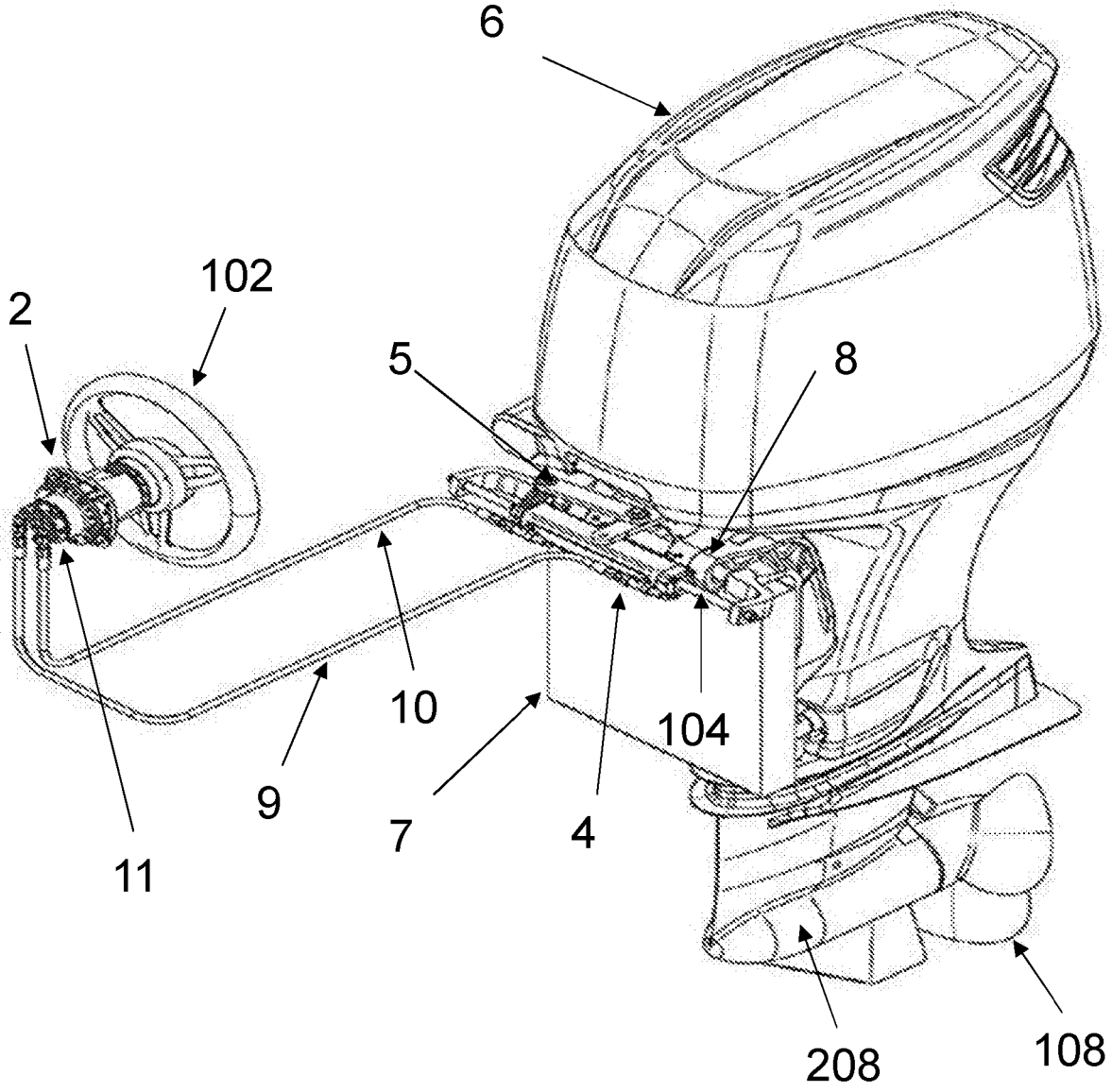
Fig. 1 (Prior Art)
FIG. 1 shows in a perspective view a steering system of an outboard motor according to the state of the art, being in said figure shown only a piece of the transom to which the motor is attached.

FIG. 1 schematically shows a steering system for a boat 7 equipped with an outboard motor 6 according to the state of the art and in particular according to documents WO2007/085515 or EP3372487. A directional control member, such as a handwheel 102, is keyed onto the shaft of a pump 2. The pump is reversible in the sense that it can operate in both directions of rotation, the delivery and intake of the pump are connected alternately according to the direction rotation, respectively to one of the two inlets/outlets of a double-acting actuator cylinder indicated as a whole by 4. The switching or exchange of connection of the delivery and intake of the pump between the two inlets/outlets of cylinder 4 according to the direction of rotation takes place by means of a switching unit 11 which has two inlet/outlet ports, each of which is connected to the corresponding inlet/outlet of the actuator cylinder 4 by means of pipes 9, 10. The pump and the switching unit 2, 11 can be for example of the type described in documents EP1382845 and EP2857680.

The double-acting cylinder comprises a rod 8 attached to motor 6 thanks to a rod which in turn is attached with its ends to those of rod 104 via brackets. Rod 104 therefore remains stationary, while depending on the direction of rotation of steering wheel 102, one of the two chambers of the double-acting cylinder is filled with pressurized fluid, causing it to slide in one direction or the other along the rod 104. A system of levers 5 connects the cylinder to an engine steering arm 6. Engine 6 is attached by means of a clamp or other removable fastening members to the transom of the boat which in FIG. 1 is symbolically represented by the part of the wall 7.

As known in the state of the art, engine 6 is supported on the attaching clamp in a rotatable way around a substantially vertical axis, hereinafter referred to as the steering axis and thanks to which propeller 108 is oriented relative to the transom and/or to the fore-aft longitudinal axis of the boat, causing its directional variation.

The propeller is supported rotatable about an axis substantially perpendicular to the axis of rotation, at the end of foot 208 of the motor and driven by the same through a transmission.

Engine 6 can generally be further pivoted about a horizontal axis and perpendicular to the steering axis and the longitudinal axis of the boat, this pivoting being called "engine tilt" and in the present example occurring about an axis substantially parallel to the rod for fixing cylinder 4 to engine 6.

Generally, engine 6 is mounted on the transom of the boat, while steering wheel assembly 102, pump 2 and distributor 11 are in a central position of the boat so that pipes 9 and 10 have a considerable length which also depends on the length of the boat.

The remaining figures show an embodiment of the present invention, wherein cylinder 4, with rod 104, end arms 204, mechanism 5 for coupling the cylinder to the steering arm of engine 6 (not shown in detail), pump 2 with the switching unit 11 and distributor/manifold 22, and motor 20 are mounted together on a single frame 21 which is intended to be attached to transom 7 of the boat.

Figure 2:
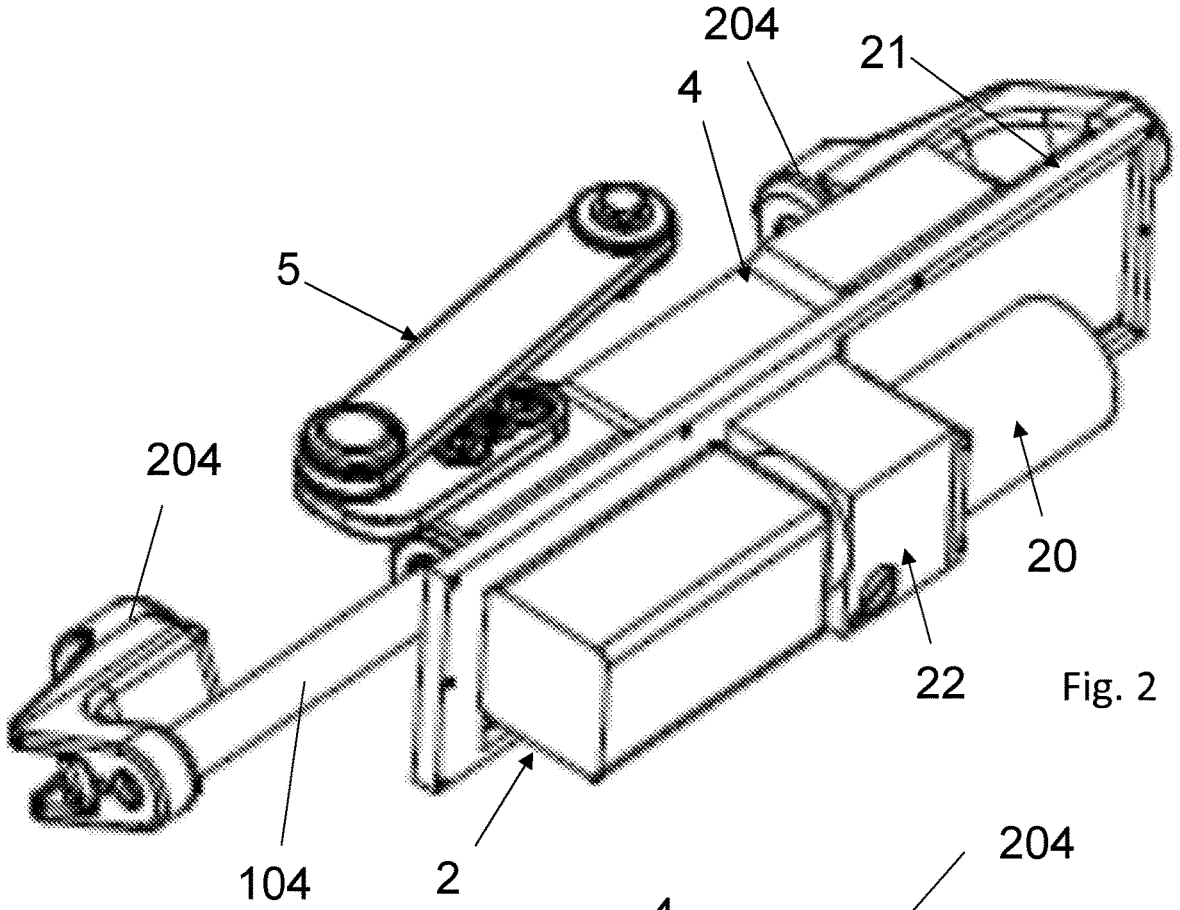
FIGS. 2 and 3 show an embodiment of the steering device according to the present invention in a perspective view and in a partially sectional view respectively.
Figure 3:
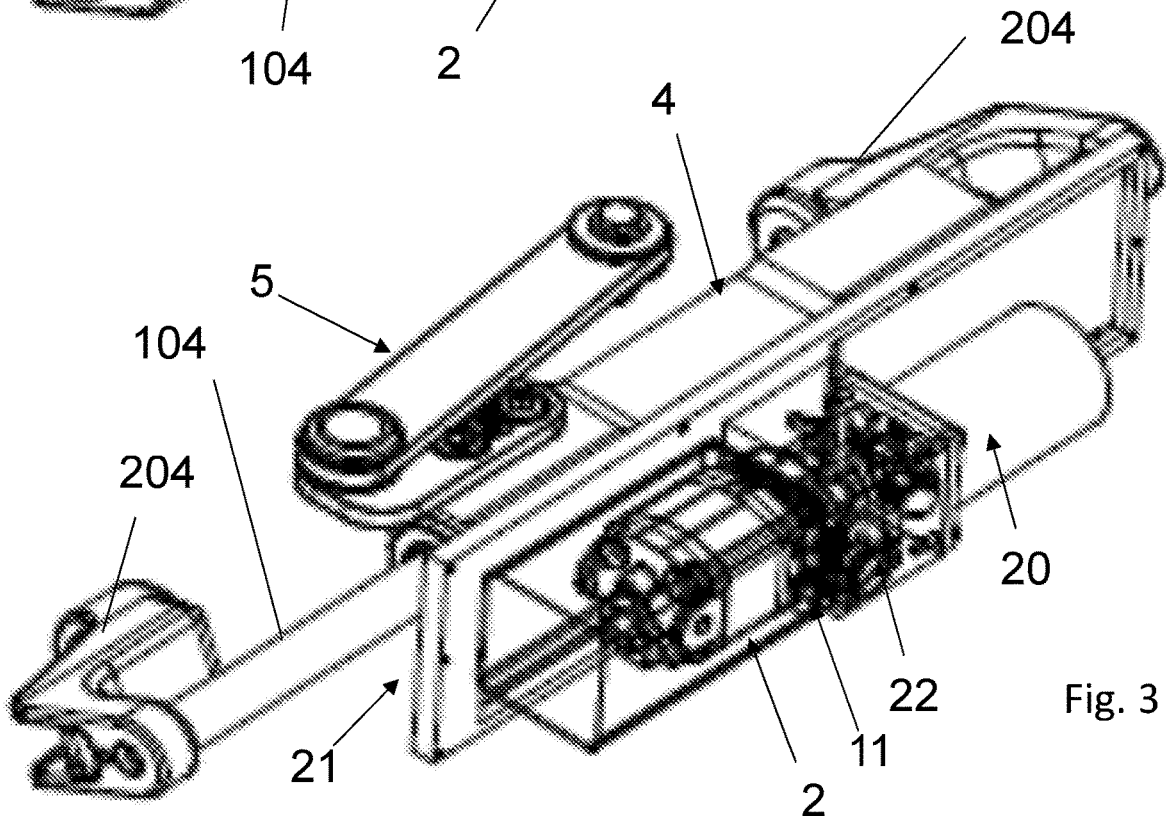
Figure 4:
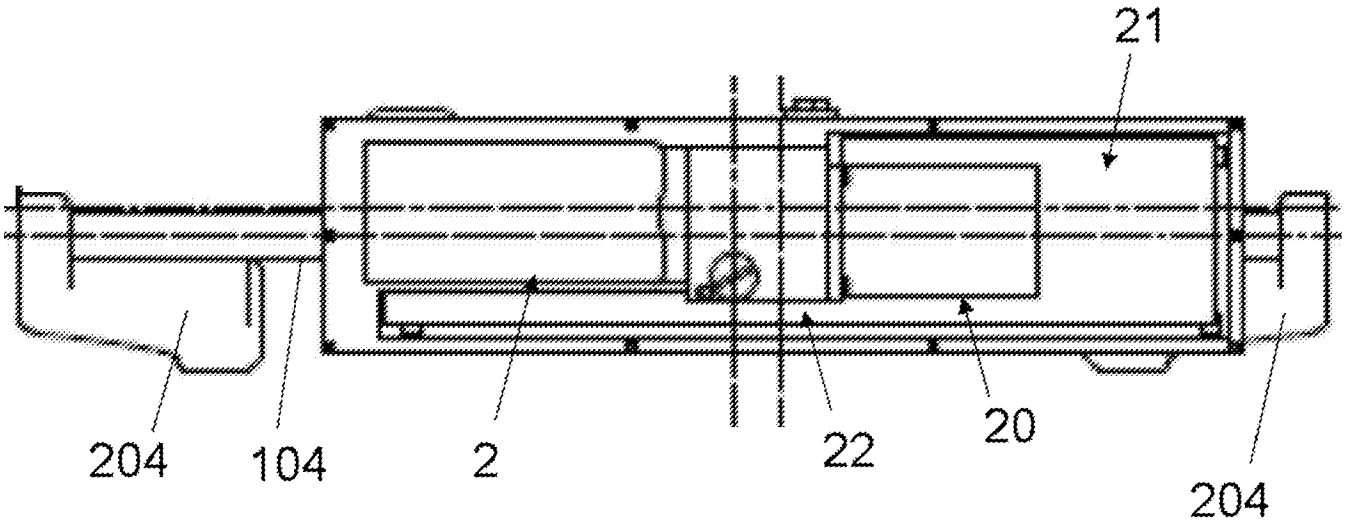
FIG. 4 shows a side elevation view of the device according to FIGS. 2 and 3 on the side opposite to that facing the engine.
Figure 5:
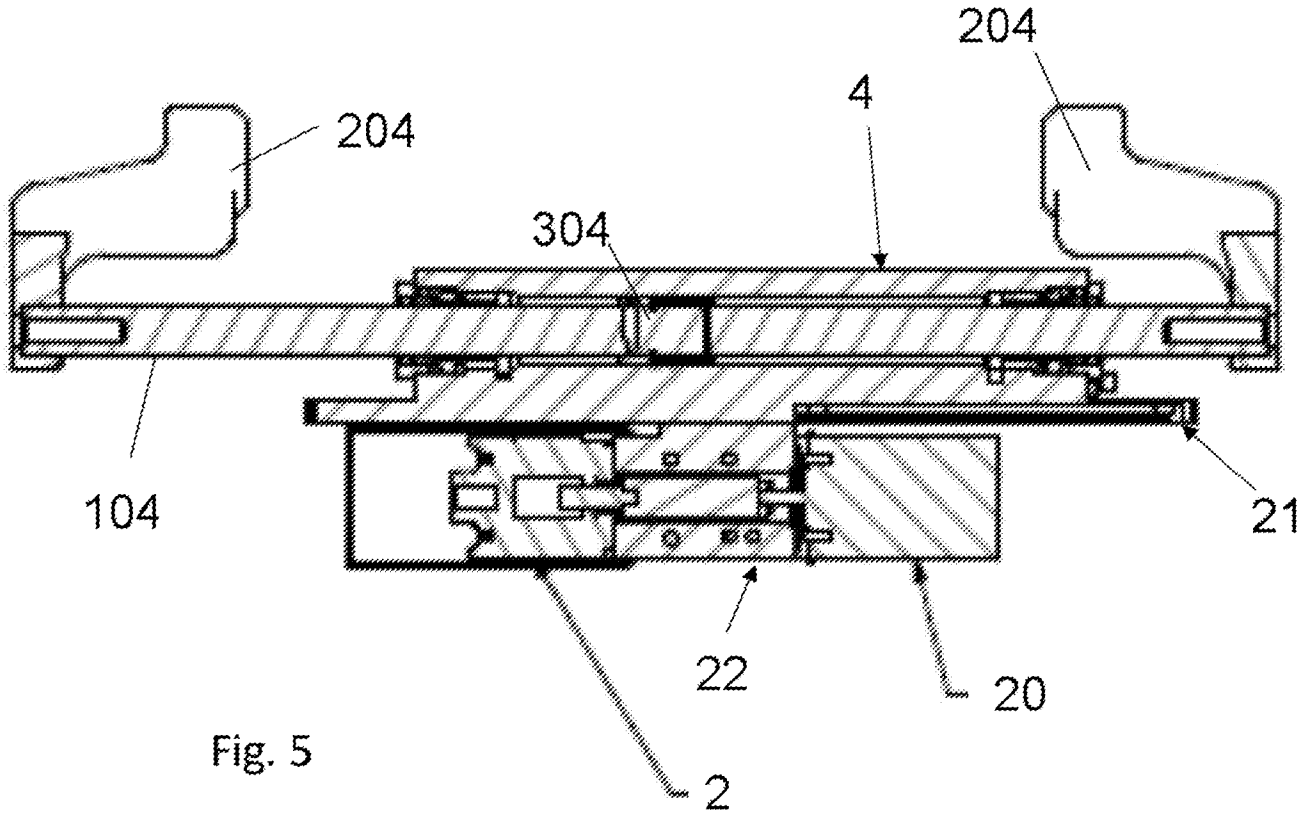
FIG. 5 shows a sectional view of the device according to the previous figures according to a section plane indicated with A-A in FIG. 4.
Figure 6:
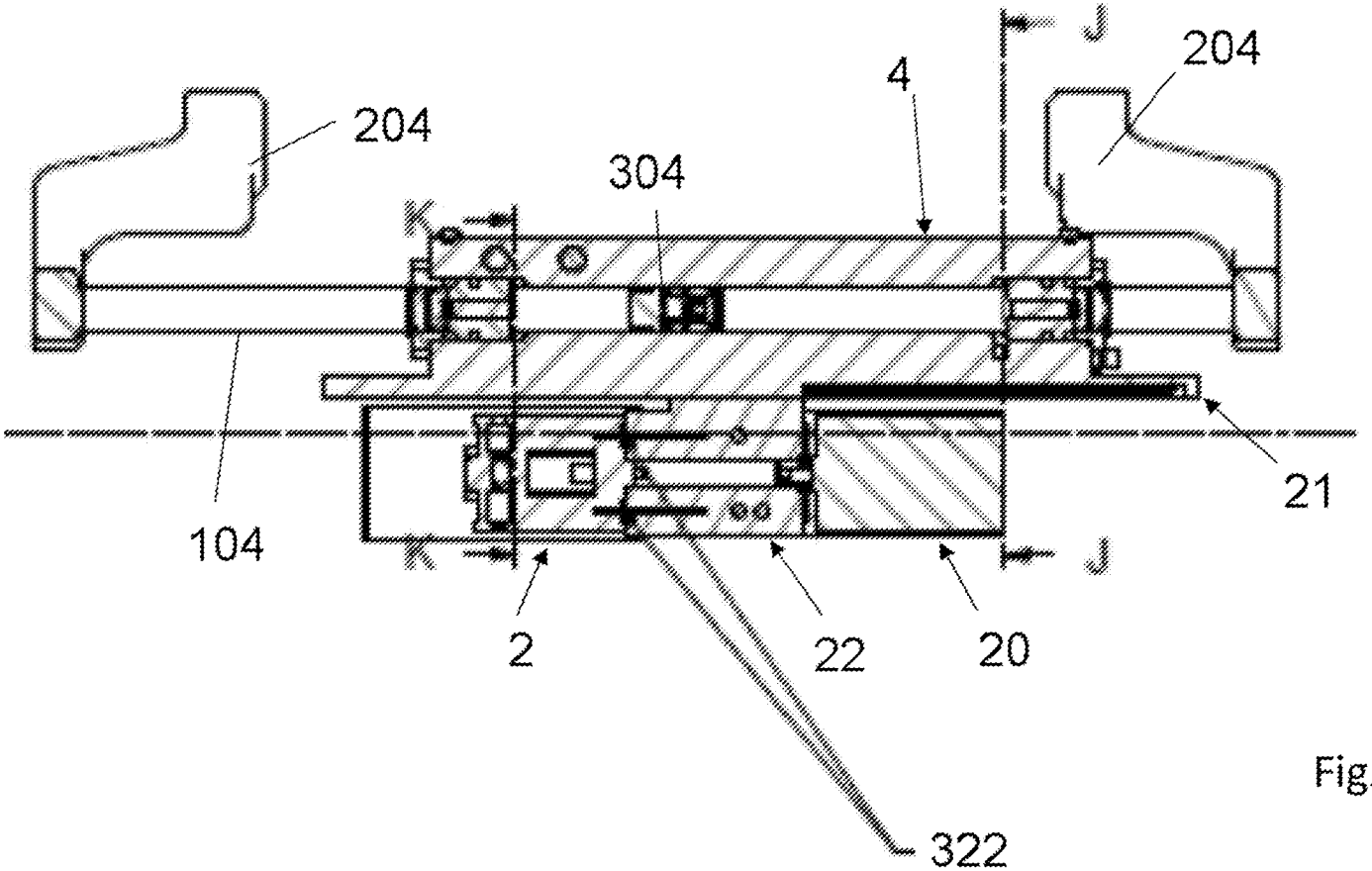
FIG. 6 is a view similar to that of FIG. 5, but according to a section plane indicated with E-E in FIG. 4.
Figure 8:
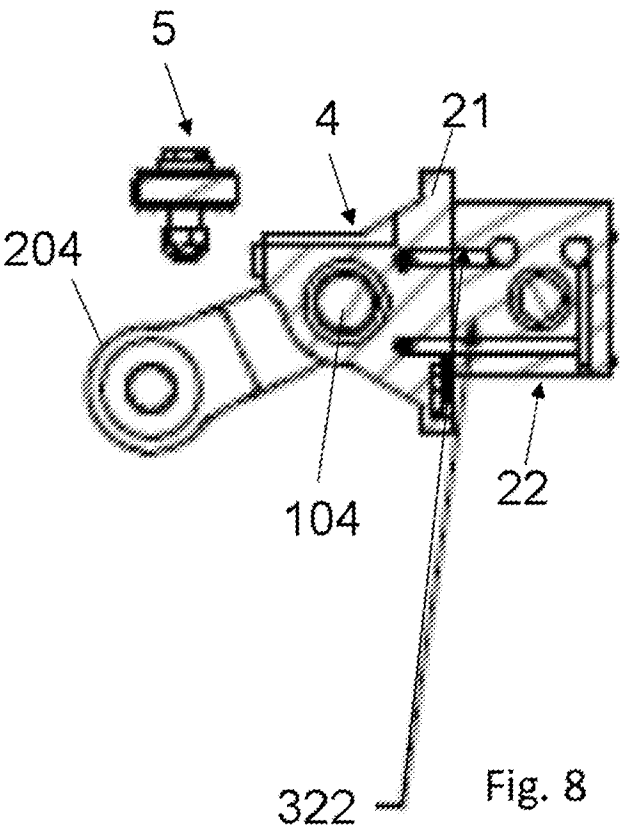
FIGS. 7 and 8 are sectional views of the device according to the previous figures respectively according to a plane B-B and a plane D-D of FIG. 4.
Figure 7:
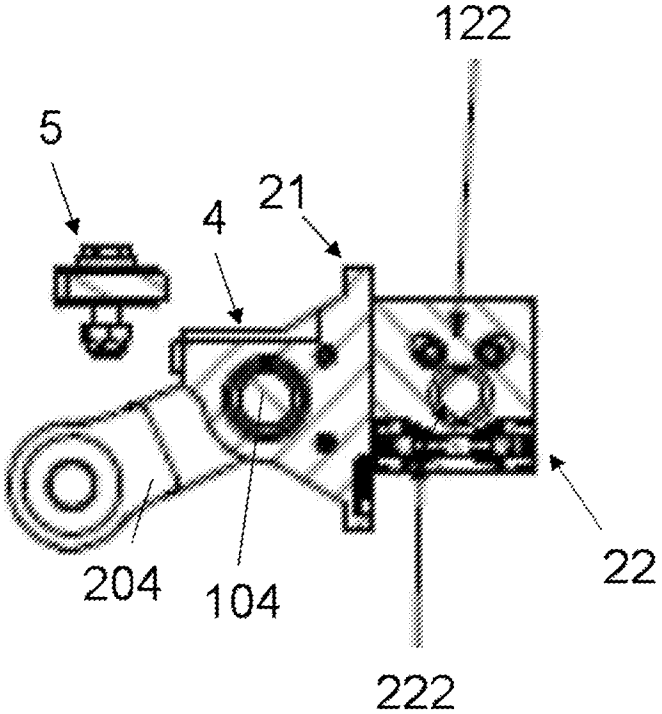
Figure 9:
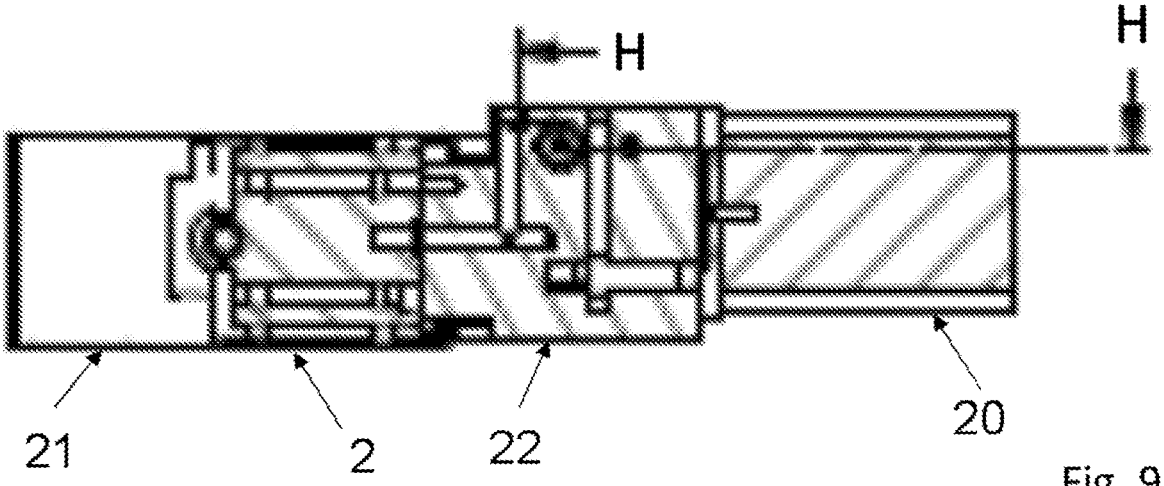
FIG. 9 shows a sectional view of the device according to the previous figures along a section plane indicated with F-F in FIG. 6.
Figure 10:
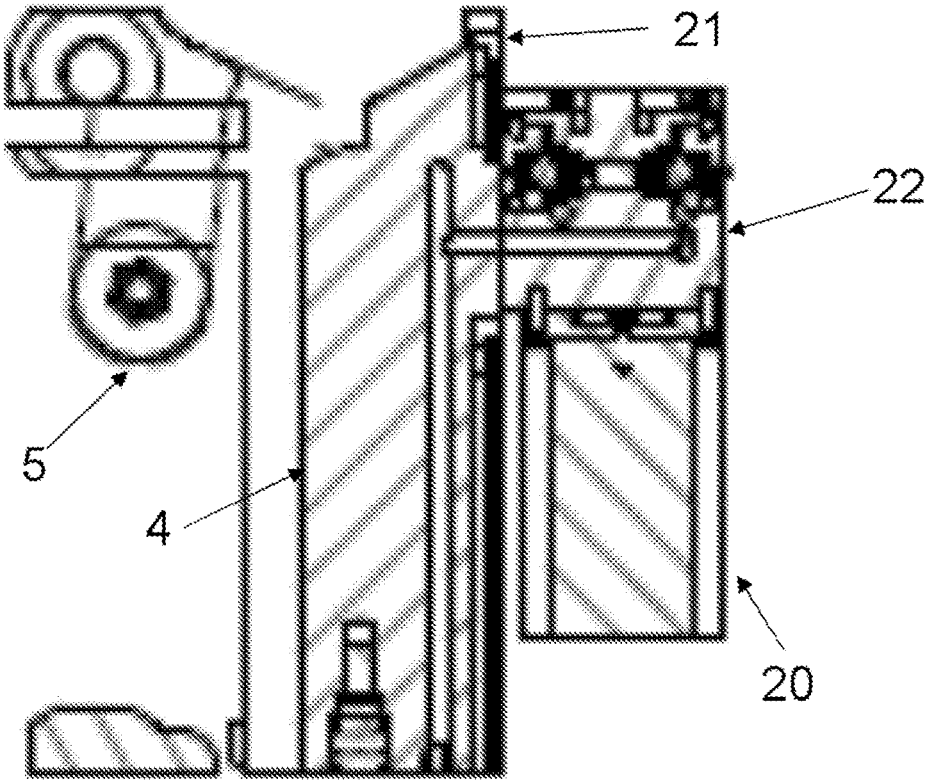
FIG. 10 shows a section view of the device according to the previous figures according to a section plane H-H of FIG. 9.
Figure 12:
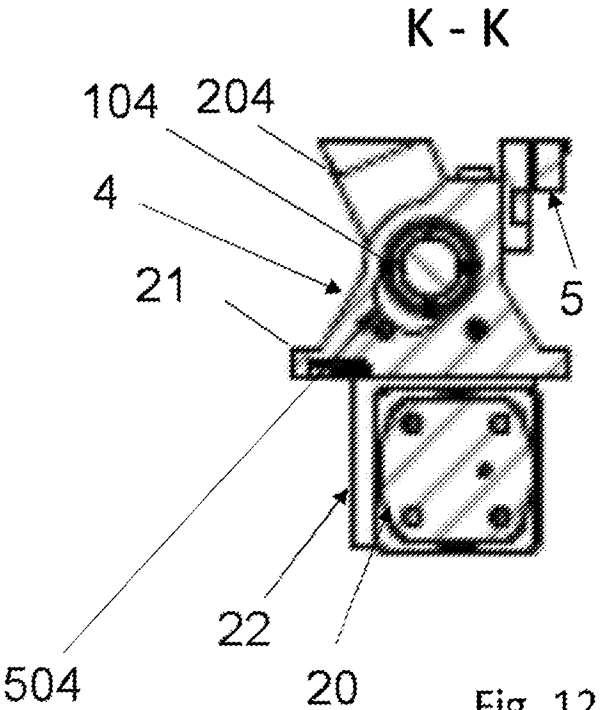
FIGS. 11 and 12 show a section view of the device according to the previous figures respectively according to a section plane J-J and according to a section plane K-K of FIG. 6.
Figure 11:
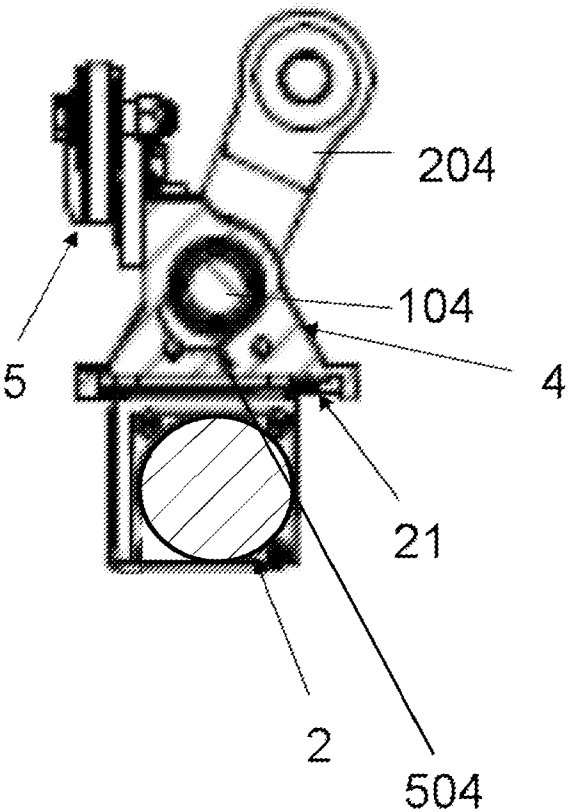

In the example shown in FIGS. 2 and 3, said frame comprises a plate to which the cylinder is attached on one side and pump 2 on the other, with switching unit 11, distributor/manifold 22 connecting the inlets/outlets of the distributor to the inlets/outlets of cylinder 4 and motor 20.

As shown in the figures, plate 21 is made of one piece with cylinder 4 and slides together with the same along rod 104. During the sliding movement, the following are also moved together with cylinder 4: motor 20, pump 2 with intake valves 122 integrated and constituting the switching unit 11 and the distributor/manifold 22 which has supply channels 322 partly made in the distributor/manifold 22 and partly in the plate 21 and in the thickness of the wall of the cylinder 4, as shown by several sectional views of FIGS. 5 to 12.

Figure 13:
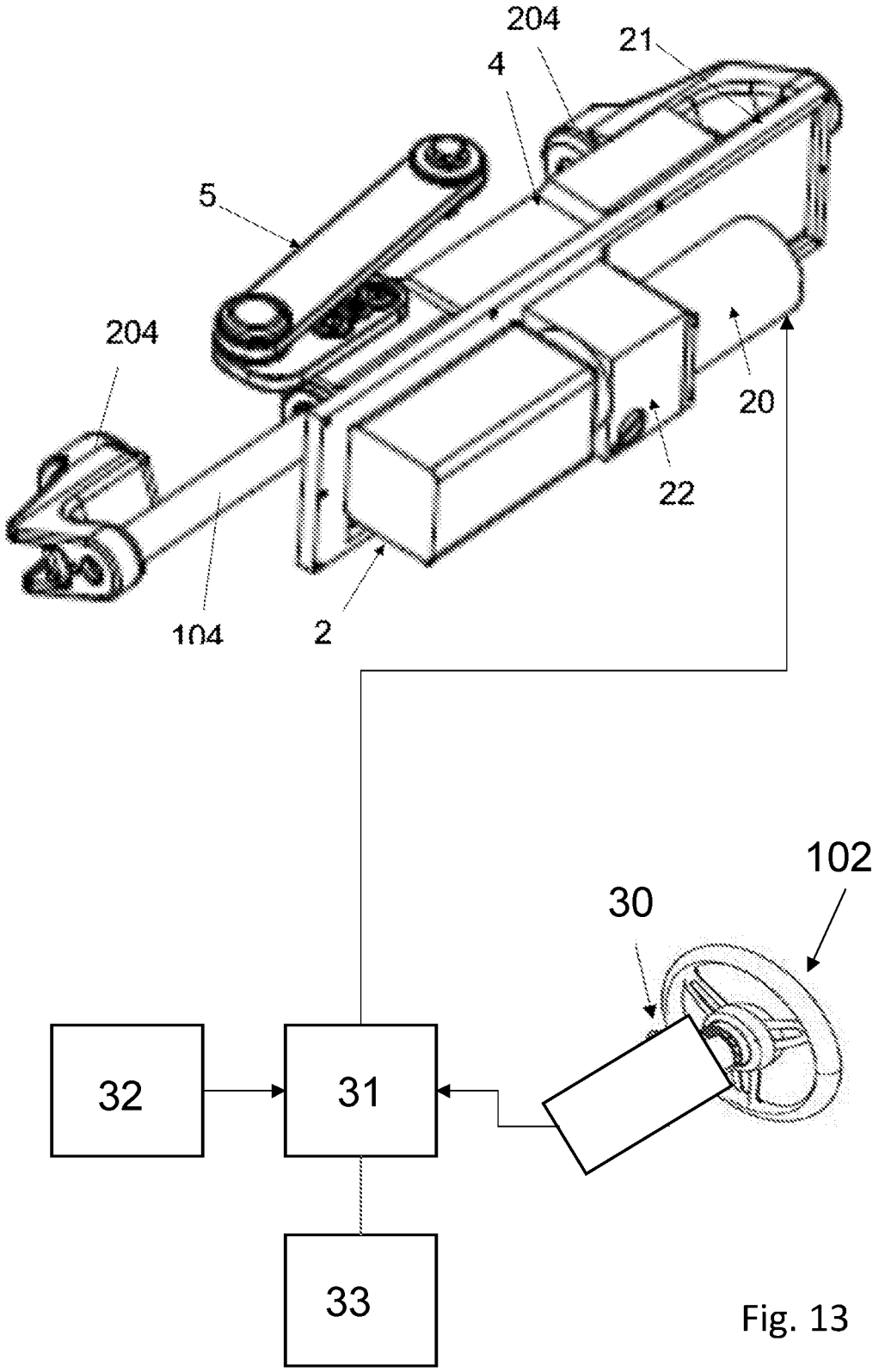
FIG. 13 schematically shows an executive example of a steering system using a steering device according to the present invention.

FIG. 13 shows a steering system for boats or the like comprising a steering device according to the present invention and in particular according to the illustrated embodiment. Steering wheel 102 is connected to a transducer of the rotation of a shaft controlled by said steering wheel in an electrical signal. There are several possibilities that provide for electromechanical, magnetic and/or optical transducers and which are generically indicated by block 30.

The electrical or optical signal generated by transducer 30 can be of the analog or digital type and in the same various physical parameters that describe the rotational motion of the shaft, such as rotation angle and/or number of revolutions, speed of rotation and/or acceleration/deceleration, as well as direction of rotation can be coded.

The electrical or optical signal is supplied to a control unit 31 configured to generate, according to the parameters encoded in said signal, a power supply signal for motor 20 which is supplied by a power output of control unit 31. The power signal, the control unit and other operating units such as transducer 30 and a possible input/output interface 33 are powered by a source of electrical energy indicated with 32.

Different system configurations are possible with regards to the arrangement of control unit 31, power source 32 and input/output interface 33.

An embodiment can provide that at least one of said units or part or all of the said units are also integrated in a single group with the cylinder, the pump, the motor and the distributor/manifold, while the steering wheel with transducer 30 are arranged in a position remote from engine 6 in which the boat steering station is provided.

An execution variant provides that the control unit, input/output interface 33 and energy source 32 or at least part of these units are arranged in the vicinity of the steering wheel and transducer 30 in the area of the control station.

According to yet another embodiment which can be provided in any combination or sub-combination with one or more of the previous embodiments and variants, the device according to the present invention can be provided in combination with an intermediate frame for attaching outboard motor 6 to the boat, which intermediate frame has an end for attaching to the boat and an end for attaching to outboard motor 6, while at least a part of said frame is like a case housing at least pump 2 inside it, with switch unit 11, distributor/manifold 22 and motor 20 as well as possibly control unit 31 and/or source of electrical energy 32.

Finally, it should be noted that the control unit can comprise a generic hardware comprising a processor with the peripherals necessary for the execution of a control program, the instructions for configuring the generic hardware being encoded in said control program to perform the functions provided for the said control unit.

According to yet another execution variant, the boat can be equipped with two or more engines, each engine or part of said engines being provided with a steering device according to the present invention and which steering devices are controlled by a common directional control member as known in the state of the art.

Figure 14:
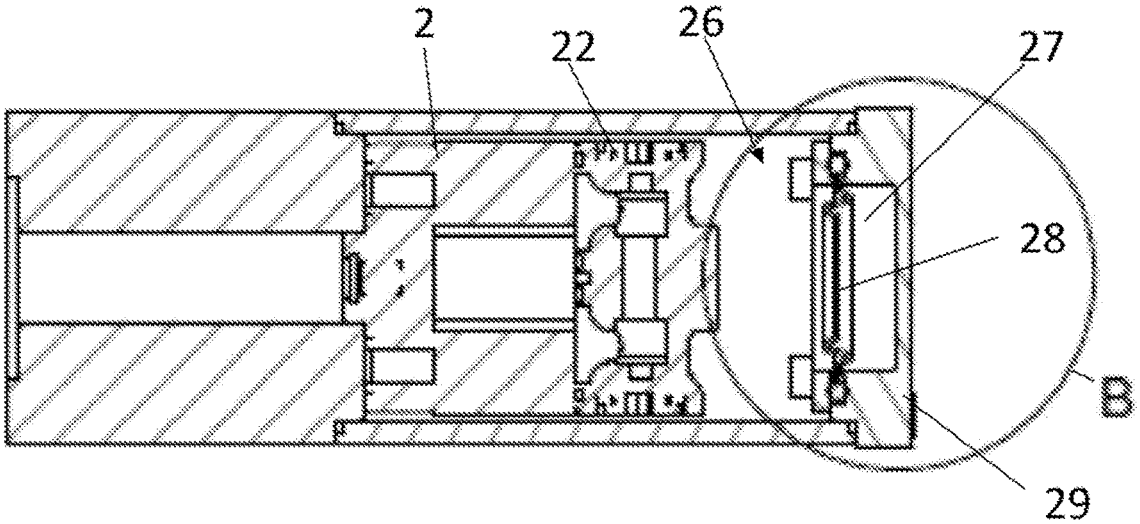
FIGS. 14 and 15 show enlarged sections of the pump, distributor and tank assembly according to an embodiment of the present invention.
Figure 15:
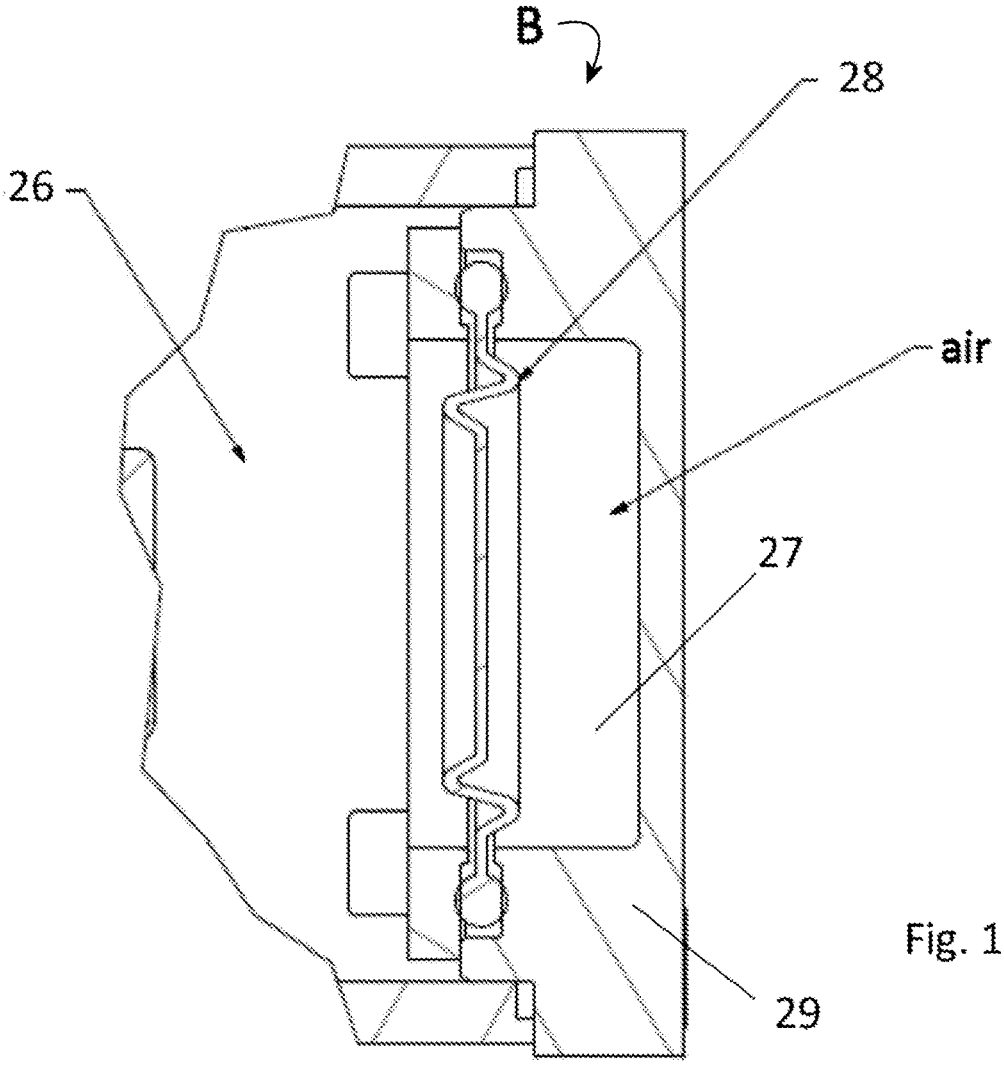

With reference to FIGS. 14 and 15, they show an execution example of integrated pump 2, distributor 22, tank 26 and motor 20 unit (not shown). In this embodiment, tank 26 has a pressure compensation chamber 27 which is separated from the remaining part of the tank by means of a membrane 28.

Compensation chamber 27 is filled with air or other fluid, in particular other gas.

According to an advantageous embodiment from the construction point of view, chamber 27 is formed in a cap 29 which closes tank 26 towards the outside and membrane 28 is integrated or constitutes the gasket between said cap 29 and tank 26.

This membrane 28 separates tank 26 full of oil from a closed compartment full of air 27, the deformability of membrane 28 allows the internal pressure of the hydraulic tank 26 to be kept constant by absorbing volume changes caused by thermal variations.

The invention claimed is:

1. A hydraulic steering device for a boat, comprising:

a pump coupled to a drive motor to supply an operating fluid alternatively along two flow directions;

a hydraulic actuating cylinder that is connected to a delivery and a return of the pump; and a fluid flow distributor that switches a connection of the delivery and suction of the pump alternatively to one of two inlets/outlets of the actuating cylinder, the fluid flow distributor communicating with one of two chambers in the actuating cylinder, wherein the actuating cylinder is mechanically articulated to a direction-changing member, the direction-changing member determining a change of direction by changing orientation relatively to an axis of the boat, wherein a change in the orientation of the direction-changing member is actuated by the actuating cylinder depending on a supply of the operating fluid to the actuating cylinder, caused by operation of the pump, wherein the drive motor has inputs for a supply signal to operate the pump at the supply of the fluid flow along one of two flow directions provided, wherein the actuating cylinder, the pump, the fluid flow distributor and the drive motor are fixed to each other by being all mounted on a single frame attached to a transom of the boat, and are translatable together with the actuating cylinder along a rod thereof, wherein the pump is provided with an integrated tank for a supply of the operating fluid to the actuating cylinder, and wherein the tank comprises a compensation chamber to compensate fluid pressure, the compensation chamber being sealingly separated from a compartment containing operating fluid by a membrane, the compensation chamber being filled with a compressible fluid.

2. The hydraulic steering device according to claim 1, wherein the compensation chamber is configured as a hollow in a closing and sealing cap of the integrated tank, the membrane being configured as a sealing gasket between the sealing cap and the integrated tank or integrated with the sealing gasket.

3. A hydraulic steering device for a boat, comprising:

a pump coupled to a drive motor to supply an operating fluid alternatively along two flow directions;

a hydraulic actuating cylinder that is connected to a delivery and return of the pump; and a fluid flow distributor that switches a connection of the delivery and suction of the pump alternatively to one of two inlets/outlets of the actuating cylinder, the fluid flow distributor communicating with one of two chambers in the actuating cylinder, wherein the actuating cylinder comprises a bar displaceable relative to the cylinder, the bar being mechanically articulated to a direction-changing member, the direction-changing member determining a change of direction by changing orientation relative to an axis of the boat, wherein a change in the orientation of the direction-changing member is actuated by the actuating cylinder depending on a supply of the operating fluid to the hydraulic cylinder, caused by operation of the pump, wherein the drive motor has inputs for a supply signal to operate the pump at the supply of the fluid flow along one of two flow directions provided, wherein the actuating cylinder, the pump, the fluid flow distributor and the drive motor are fixed to each other so as to form an operative unit integrated into a single body by being all mounted on a single frame attached to a transom of the boat, and are translatable together with the actuating cylinder along a rod thereof, wherein the pump is provided with an integrated tank for a supply of the operating fluid to the actuating cylinder, and wherein the tank comprises a compensation chamber to compensate fluid pressure, the compensation chamber being sealingly separated from a compartment containing operating fluid by a membrane, the compensation chamber being filled with a compressible fluid.

4. The hydraulic steering device according to claim 3, wherein ducts that connect the pump, in the flow distributor to the inlets/outlets of the actuating cylinder are made partly integral with a supporting plate integral with the actuating cylinder to which at least the cylinder, the pump, the flow distributor and the drive motor are fixed.

5. The hydraulic steering device according to claim 4, wherein the supporting plate is adapted to be fixed or is fixed to the actuating cylinder, or wherein the supporting plate and the actuating cylinder are made in one piece in a single body.

6. The hydraulic steering device according claim 3, wherein the hydraulic cylinder is double-acting for a hydraulic steering device of an outboard marine engine, wherein the actuating cylinder is slidingly mounted on a rod coaxial to the cylinder, the rod sealingly protruding from at least one head of the actuating cylinder and bearing a separating piston that divides the actuating cylinder into two chambers of variable volume, each of the two chambers having at least one inlet/outlet for the operating fluid, the inlet/outlet being connected to the delivery and suction of the pump.

7. The hydraulic steering device according to claim 3, wherein the hydraulic steering device is part of a steering system for the boat, the device hydraulic steering being provided in combination with:

a steering control member causing a steering control signal to be generated;

a control unit that transforms the steering control signal into a corresponding supply signal of the drive motor; and an electric power source for the supply signal of the drive motor.

8. The hydraulic steering device according to claim 7, wherein the control unit and/or electric power source are supported by a supporting frame shared with a structure of the actuating cylinder.

9. The hydraulic steering device according to claim 8, wherein the supporting frame is shaped as a fastening plate for fastening to a transom or another fixed part of the boat.

10. The hydraulic steering device according to claim 9, wherein the actuating cylinder is supported on a face of the fastening plate, and wherein the drive motor, the pump, and a distribution valve are supported on a face of the fastening plate opposite the actuating cylinder.

11. The hydraulic steering device according to claim 10, wherein the hydraulic steering device is fixed to an intermediate fastening framework for fastening the drive motor to the boat.

* * * * *